US006244592B1

(12) United States Patent
Baba et al.

(10) Patent No.: US 6,244,592 B1
(45) **Date of Patent: *Jun. 12, 2001**

(54) SHEET FEEDING APPARATUS FOR A CORRUGATED FIBERBOARD CONTAINER MAKING MACHINE

(75) Inventors: Yasuyuki Baba; Osamu Hatano, both of Mihara (JP)

(73) Assignee: Mitsubishi Heavy Industries, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/321,336

(22) Filed: May 27, 1999

(30) Foreign Application Priority Data

Jun. 22, 1998 (JP) ..... 10-174658

(51) Int. Cl.[7] ..... B65H 9/04

(52) U.S. Cl. ..... 271/243; 271/245; 271/253

(58) Field of Search ..... 271/243, 244, 271/245, 253, 254

(56) References Cited

U.S. PATENT DOCUMENTS

| | | | | |
|---|---|---|---|---|
| 5,113,994 | * | 5/1992 | Mueck | 271/245 X |
| 5,147,092 | * | 9/1992 | Driscoll et al. | 271/245 X |
| 5,172,898 | * | 12/1992 | Takahashi | 271/243 X |

FOREIGN PATENT DOCUMENTS

| | | |
|---|---|---|
| 275050 | 6/1914 | (DE) . |
| 2 137 661 | 2/1973 | (DE) . |
| 30 02 594 | 8/1980 | (DE) . |
| 0238020 | 9/1987 | (EP) . |
| 0794140 | 9/1997 | (EP) . |

* cited by examiner

*Primary Examiner*—David H. Bollinger
(74) *Attorney, Agent, or Firm*—Alston & Bird LLP

(57) ABSTRACT

The present invention provides a sheet feeding apparatus for a corrugated fiberboard box making machine, which has front stops disposed at two locations spaced in the width direction (transverse direction) to true up the front edges of stacked corrugated fiberboard sheets and is constructed so as to feed a lowermost corrugated fiberboard sheet successively from the front end side of the front stop, characterized in that the front stops at the two locations are constructed so as to be movable in the longitudinal direction in such a manner as to be capable of supporting the corrugated fiberboard sheets while tilting the front edges thereof obliquely in the longitudinal direction.

3 Claims, 6 Drawing Sheets

SHEET FEEDING APPARATUS FOR A CORRUGATED FIBERBOARD CONTAINER MAKING MACHINE

BACKGROUND OF THE INVENTION AND RELATED ART STATEMENT

1. Field of the Invention

The present invention relates to a sheet feeding apparatus for a corrugated fiberboard container making machine for feeding stacked corrugated fiberboard sheets one after another.

2. Description of Related Art

FIGS. 8 and 9 are explanatory views showing outlines of conventional sheet feeding apparatuses for a corrugated fiberboard container. In FIG. 8, frames 1 are erected on both sides, right and left, of a table 2, and a beam 3 is installed between the frames 1. A hopper 6 is defined by front stops 4 attached to the beam 3 and side guides 5, and corrugated fiberboard sheets 7 are stacked on the table in this hopper 6. A lowermost sheet 7*a* of the stacked corrugated fiberboard sheets 7 is kicked from one end side by a kicker 8 and reaches feed rolls 9 on the other end side as indicated by the chain line. Then, the sheet 7*a* is pulled by the feed rolls 9 and is sent to the following process (for example, a printing section 10).

FIG. 9 shows an outline of a sheet feeding apparatus of another type. In this sheet feeding apparatus, delivery rolls 11 are provided under the front stops 4 in place of the kicker 8, and the vacuum pressure in a vacuum box (suction box) 12 attracts the lowermost sheet 7*a* to the surface of the delivery rolls 11, so that the sheet 7*a* is delivered by a frictional force.

The above-described conventional sheet feeding apparatuses for a corrugated fiberboard box making machine have problems as described below. For example, if the feed roll 9 wears eccentrically, the feeding force becomes nonuniform in the transverse direction. Also, in the case shown in FIG. 9, if the corrugated fiberboard sheet 7 is warped, the contact pressure between the delivery roll 11 and the lowermost sheet 7*a* of the corrugated fiberboard sheets 7 becomes nonuniform in the transverse direction even with the aid of the suction pressure of the vacuum box 12. Particularly for a corrugated fiberboard sheet with high flexural rigidity such as a double-sided sheet, such tendency is remarkable.

Thus, when a feeding force that is nonuniform in the transverse direction is applied to the corrugated fiberboard sheet 7 under the mechanical condition of eccentric wear of the feed roll 9 or under the condition of warped sheet 7, the sheet 7 is fed while being turned obliquely at a predetermined angle as shown in FIG. 10. The sheet 7 fed in this manner decreases the accuracy of box made in the subsequent process. Therefore, the accuracy is kept by a correction, for example, by decreasing the sheet feed speed or by purposely installing the kicker 8 slantwise.

Since such a tendency for oblique turning is often developed by the eccentric wear of the feed roll 9, the warping of the corrugated fiberboard sheet 7, and the like as described above, the oblique turning does not occur at random for each corrugated fiberboard sheet 7, but there is a tendency for all corrugated fiberboard sheets 7 of a certain production lot to be turned obliquely in the same manner.

OBJECT AND SUMMARY OF THE INVENTION

The present invention has been made in view of the above situation, and accordingly an object thereof is to provide a sheet feeding apparatus for a corrugated fiberboard box making machine in which even if corrugated fiberboard sheets have a tendency for oblique turning, the tendency for oblique turning can be adjusted easily.

To solve the problem with the above-described prior art, according to the invention defined in claim 1, there is provided a sheet feeding apparatus for a corrugated fiberboard box making machine, which has front stops disposed at two locations spaced in the width direction to true up the front edges of stacked corrugated fiberboard sheets and is constructed so as to feed a lowermost corrugated fiberboard sheet successively from the front end side of the front stop, characterized in that the front stops at the two locations are constructed so as to be movable in the longitudinal direction in such a manner as to be capable of supporting the corrugated fiberboard sheets while tilting the front edges thereof obliquely in the longitudinal direction.

According to the invention defined in claim 2, in the invention according to claim 1, the front stops are disposed at two locations on a beam which extends in the width direction and can be tilted slantwise in the longitudinal direction with one end thereof in the width direction being a fulcrum, and are constructed so as to support the corrugated fiberboard sheets while tilting the front edges thereof obliquely in the longitudinal direction by moving together with the beam.

According to the invention defined in claim 3, in the invention according to claim 1, the front stops are disposed at two locations on a beam extending in the width direction, and are constructed so as to support the corrugated fiberboard sheets while tilting the front edges thereof obliquely in the longitudinal direction by moving individually in the longitudinal direction with respect to the beam.

As described above, in the invention defined in claim 1, the two front stops are constructed so as to be movable in the longitudinal direction in such a manner as to be capable of supporting the corrugated fiberboard sheets while tilting the front edges thereof obliquely in the longitudinal direction. Therefore, even if corrugated fiberboard sheets have a tendency for oblique turning, the tendency for oblique turning can be adjusted easily to a straight state, for example.

Also, in the invention defined in claim 2, since the two front stops are disposed on a beam which can be tilted slantwise in the longitudinal direction, the positions and directions of the two front stops can be changed at the same time merely by changing the tilt of the beam. Therefore, the direction of the corrugated fiberboard sheet 7 can be corrected quickly. In addition, the same effect as that of the invention defined in claim 1 can be achieved.

Further, in the invention defined in claim 3, since the two front stops are moved individually in the longitudinal direction with respect to the beam, the direction of the corrugated fiberboard sheet can easily be adjusted finely.

DETAILED DESCRIPTION OF PREFERRED EMBODIMENTS

Figure 4:
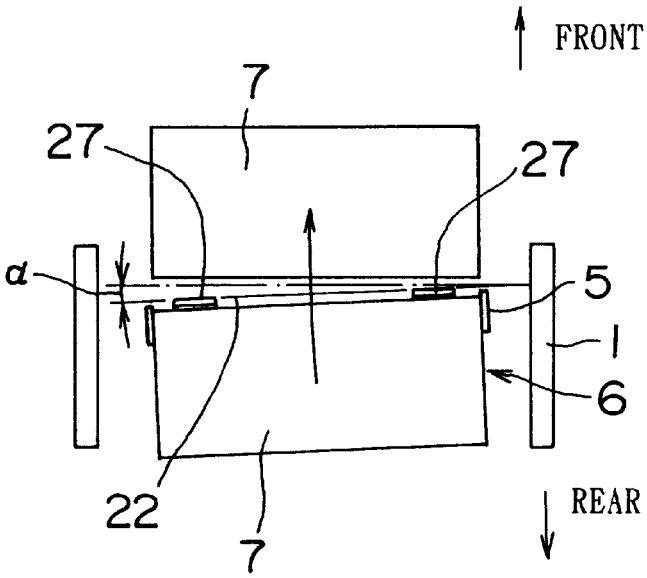
FIG. 4 is a plan view showing the operation of the sheet feeding apparatus for a corrugated fiberboard container making machine.
Figure 5:
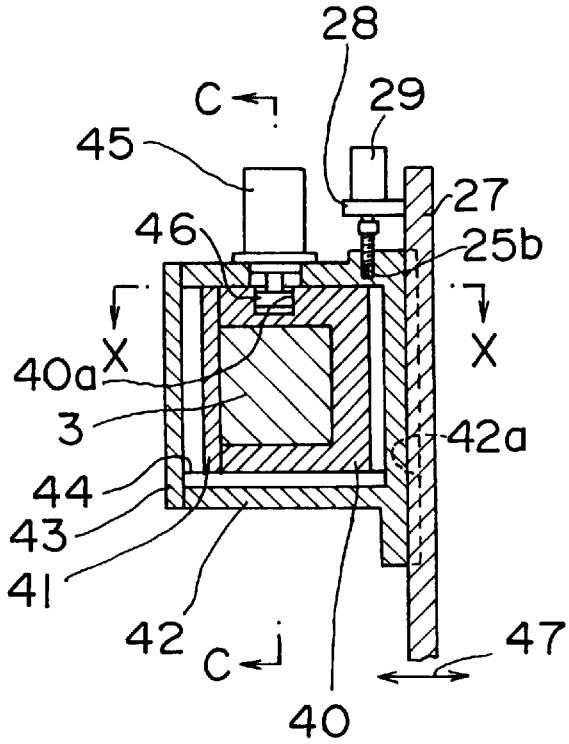
FIG. 5 is a sectional view of a principal portion of a sheet feeding apparatus for a corrugated fiberboard container making machine in accordance with a second embodiment of the present invention.
Figure 6:
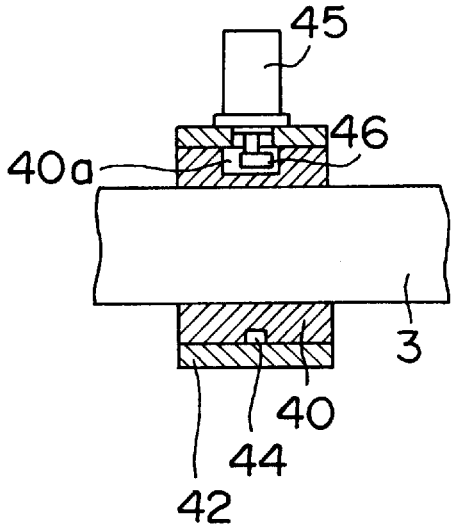
FIG. 6 is a sectional view taken along the line C—C of FIG. 5, showing the sheet feeding apparatus for a corrugated fiberboard container making machine.
Figure 7:
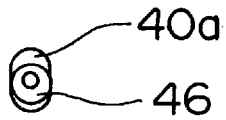
FIG. 7 is a sectional view taken along the line X—X of FIG. 5, showing the sheet feeding apparatus for a corrugated fiberboard container making machine.
Figure 8:
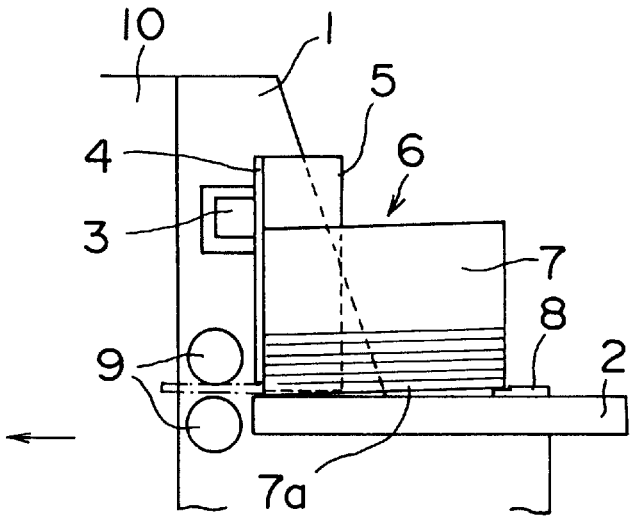
FIG.8 (RELATED ART)
FIG. 8 is an explanatory view of a sheet feeding apparatus for a corrugated fiberboard container making machine of a conventional example.
Figure 9:
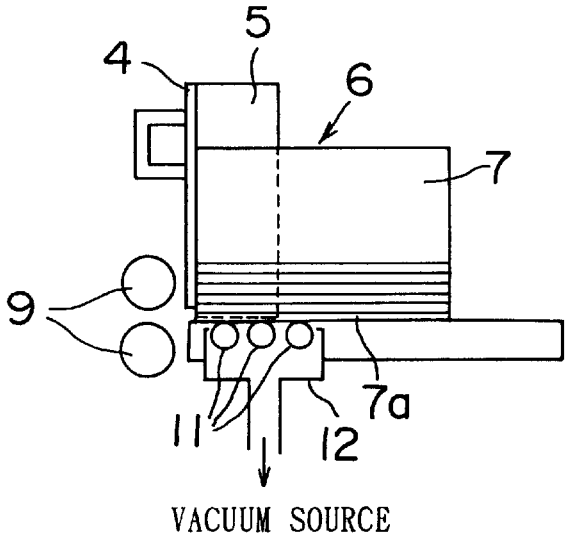
FIG.9 (RELATED ART)
FIG. 9 is an explanatory view of a sheet feeding apparatus for a corrugated fiberboard container making machine of another conventional example.
Figure 10:
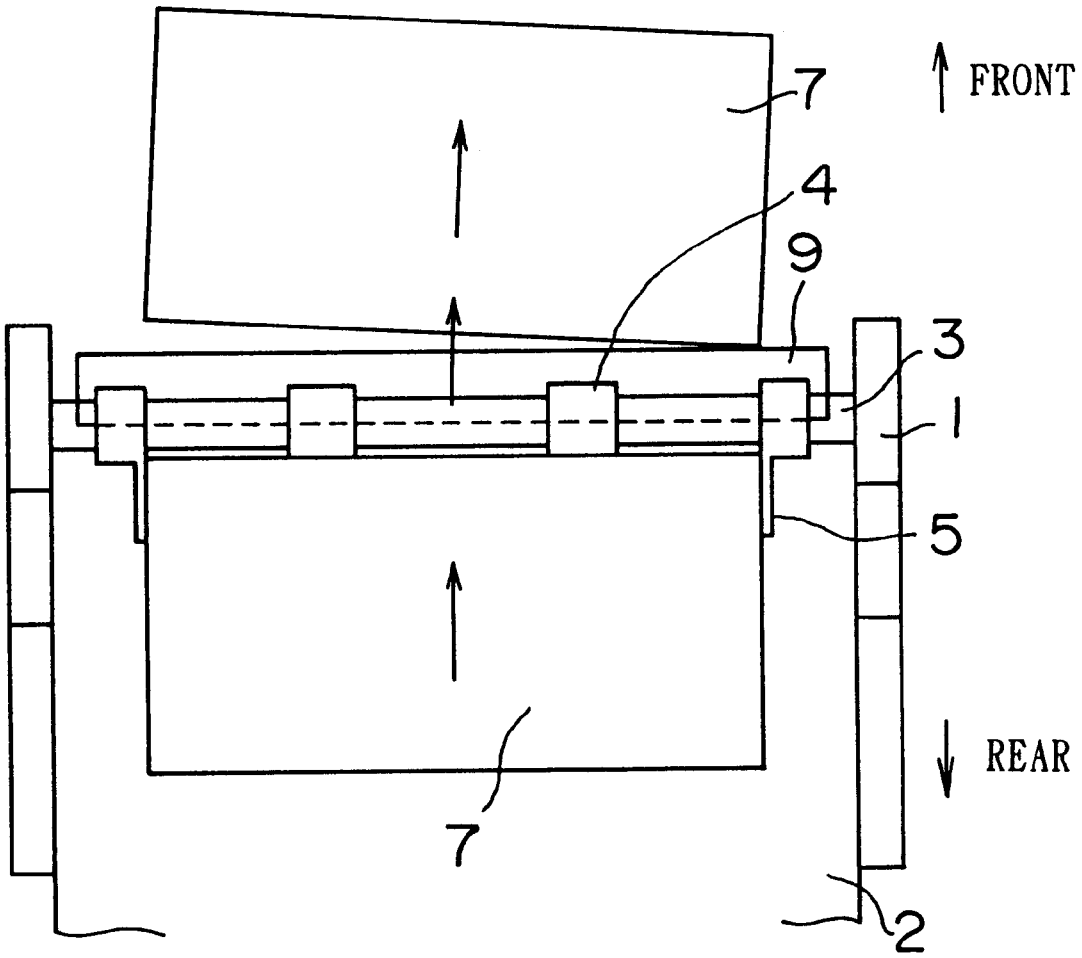
FIG.10 (RELATED ART)
FIG. 10 is a plan view showing a problem with the sheet feeding apparatus for a corrugated fiberboard container making machine of the conventional example.

Embodiments of the present invention will be described below with reference to FIGS. 1 to 7. FIGS. 1 to 4 show a first embodiment, and FIGS. 5 to 7 show a second embodiment.

First, the first embodiment of the present invention will be described with reference to FIGS. 1 to 4. In these figures, the same reference numerals are applied to elements common to those of the conventional example, and the duplicated explanation of those elements is simplified. The sheet feeding apparatus for a corrugated fiberboard container making machine has front stops 27, which are disposed at two locations a predetermined distance away from each other in the transverse direction (the width direction), for truing up the front edges of the sheets 7 so that a lowermost corrugated fiberboard sheet 7 is fed successively from the front end side. The front stops 27 at the aforesaid two locations are constructed movably in the longitudinal direction so as to be capable of supporting the corrugated fiberboard sheets 7 while tilting them obliquely in the longitudinal direction. The front stops 27 are mounted at two predetermined locations of a beam 22 which extends in the transverse direction and is capable of being tilted obliquely in the longitudinal direction with one end in the transverse direction being a fulcrum, and are constructed so as to support the corrugated fiberboard sheets 7 while tilting the front edges thereof obliquely in the longitudinal direction by moving together with the beam 22.

Figure 1:
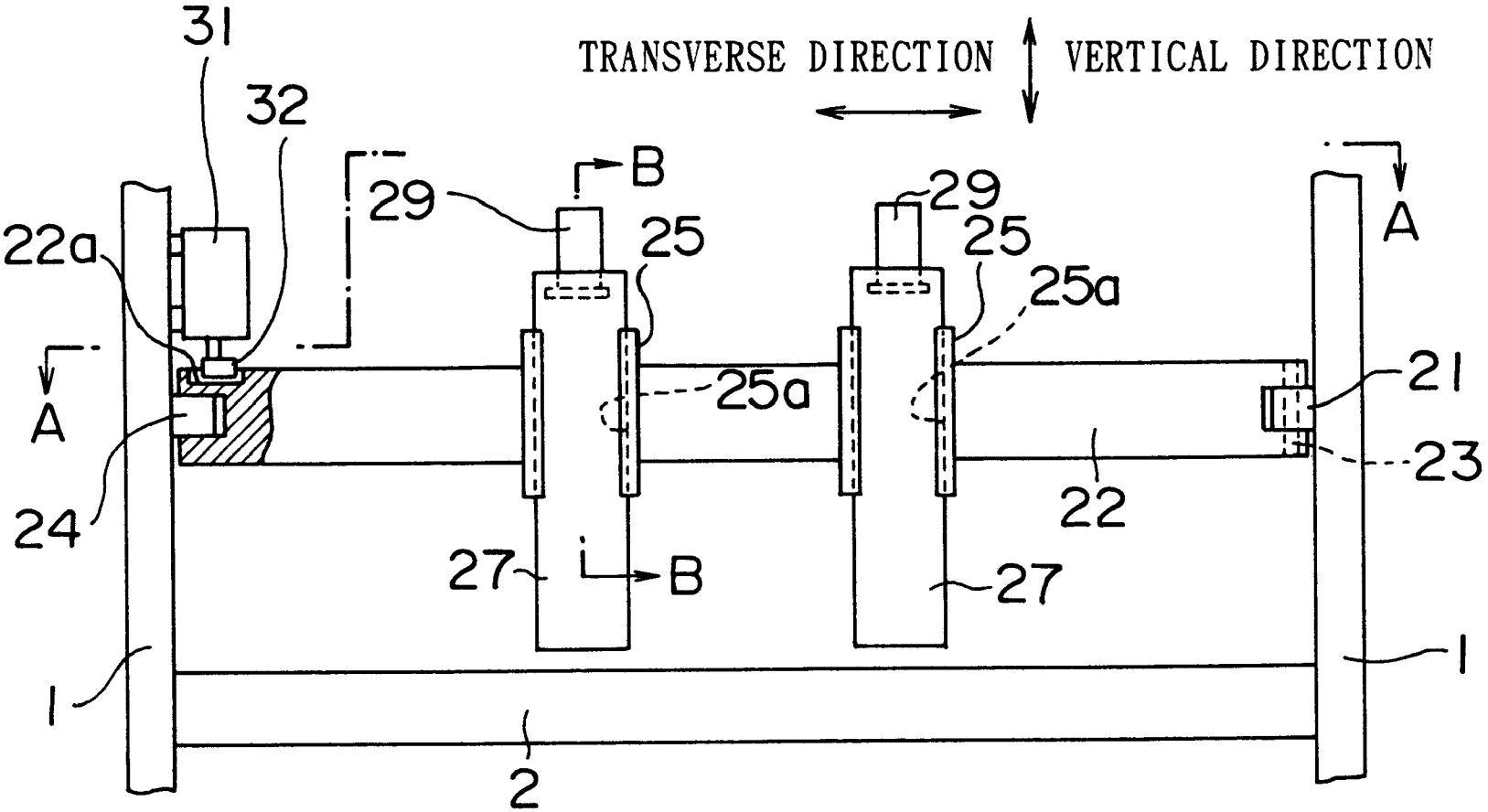
FIG. 1 is a front view of a sheet feeding apparatus for a corrugated fiberboard container making machine in accordance with a first embodiment of the present invention.
Figure 2:
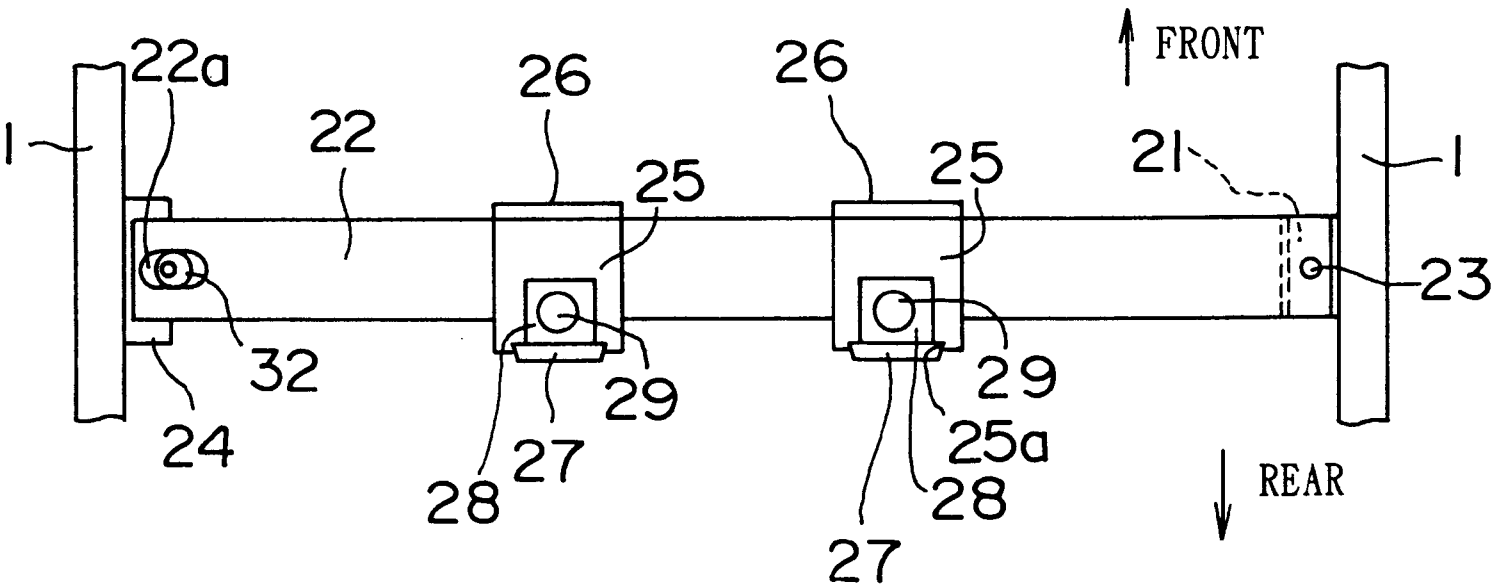
FIG. 2 is a sectional view taken along the line A—A of FIG. 1, showing the sheet feeding apparatus for a corrugated fiberboard container making machine.

Next, the above-described construction will be described in more detail. Of the frames 1 disposed at right and left, the frame 1 located on the right side in FIGS. 1 and 2 is fitted with a mounting base 21 by welding or other means. On this mounting base 21, one end of the beam 22 is supported via a fulcrum pin 23 so as to be rotatable in the longitudinal direction with respect to the sheet advance direction. The other end of the beam 22 is slidably supported via a groove portion formed so as to hold a support base 24 fixed to the frame 1 on the opposite side (left side).

Figure 3:
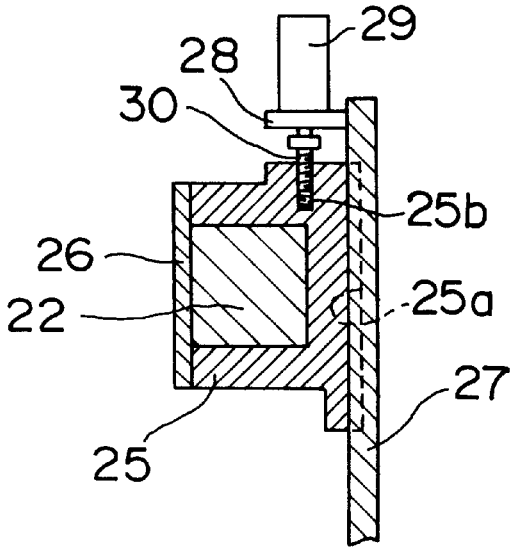
FIG. 3 is a sectional view taken along the line B—B of FIG. 1, showing the sheet feeding apparatus for a corrugated fiberboard container making machine.

As shown in FIG. 3, the beam 22 is fitted with a bracket 25 having a U shape in cross section and a keep plate 26 which are slidable in the axial direction (transverse direction). The bracket 25 and the keep plate 26 enclose the beam 22. A face of the bracket 25 on the side opposite to the beam 22 is formed with a dovetail groove 25*a*, and the front stop 27 is fitted in this dovetail groove 25*a* so as to be slidable in the vertical direction. On a mounting base 28 fixed to the upper part of the front stop 27 is mounted a motor 29. A screw shaft 30, which is fixed to the shaft of the motor 29, engages with a screw hole 25*b* in the bracket 25. Therefore, when the motor 29 is rotated, the screw shaft 30 goes into and out of the bracket 25, and accordingly the front stop 27 moves vertically, so that a gap between the lower edge of the front stop 27 and the table 2 can be changed according to the thickness of the corrugated fiber board 7 being worked.

A motor 31 is mounted above the support base 24 of the frame 1 on the sliding side of the beam 22, that is, on the left side. On the shaft of this motor 31 is fixed an eccentric ring (eccentric cam) 32, which fits in an oval-shaped groove 22*a* in the beam 22. Therefore, when the motor 31 is rotated, the beam 22 sways in the longitudinal direction (sheet advance direction) with the fulcrum pin 23 being a fulcrum.

In the sheet feeding apparatus for a corrugated fiberboard box making machine constructed as described above, by rotating the motor 31, the beam 22 is tilted obliquely in the longitudinal direction with the fulcrum pin 23 being a fulcrum, so that the two front stops 27 provided on the beam 22 also move in the longitudinal direction in a tilted manner. That is to say, a hopper 6 can be tilted as shown in FIG. 4. Therefore, if the corrugated fiberboard sheet 7 is turned obliquely, for example, at an angle of a when the sheet 7 is fed from the normal position of the hopper 6, at which position the sheet 7 is not tilted (the front edges of the corrugated fiberboard sheets 7 are arranged perpendicularly to the sheet advance direction), the two front stops 27 are tilted at the turning angle $\alpha$ of the corrugated fiberboard sheet 7 in the reverse direction in advance, whereby the posture of the corrugated fiberboard sheet 7 can be corrected. Therefore, the corrugated fiberboard sheet 7 takes a correct posture when being fed and reaching the downstream process such as a printing section, that is, the corrugated fiberboard sheet 7 can be fed straight from the table 2 to the next process.

Thereupon, unlike the conventional sheet feeding apparatus, there is no need for decreasing the sheet feed speed or for correcting the attachment of a kicker, and the feed direction of the corrugated fiberboard sheet 7 can be adjusted easily. Further, merely by changing the tilt of the beam 22, the positions and directions of the two front stops 27 can be change at the same time, so that the direction of the corrugated fiberboard sheet 7 can be corrected quickly.

Next, the second embodiment of the present invention will be described with reference to FIGS. 5 to 7. In these figures, the same reference numerals are applied to elements common to those of the conventional example and the first embodiment, and the duplicated explanation of those elements is simplified.

In the above-described first embodiment, the beam 22 fitted with the front stops 27 is tiltable, by which the direction in which the corrugated fiberboard sheets 7 are held by the two front stops 27 can be changed easily. In the second embodiment, contrarily, the beam 3 is fixed to the frames 1 as before, and the two front stops 27 themselves can be made movable in the longitudinal direction with respect to the beam 3, by which the direction in which the corrugated fiberboard sheets 7 are held by the two front stops 27 can be changed easily.

Specifically, the beam 3 fixed to the frames 1 is fitted with an inside bracket 40 by using a keep plate 41, and the inside bracket 40 is configured so as to be slidable on the beam 3 in the axial direction (lengthwise direction). Also, on the outside of the inside bracket 40, an outside bracket 42 is installed by being guided by a key member 44 so as to be slidable to the right and left in FIG. 5 (longitudinally with respect to the sheet advance direction). A keep plate 43 is installed on the opening side of the outside bracket 42 to prevent the outside bracket 42 from coming off from the inside bracket 40. A face of the outside bracket 42 on the side opposite to the beam 3 is formed with a dovetail groove 42*a*, and the front stop 27 is fitted in this dovetail groove 42*a* so as to be slidable in the vertical direction and can be moved vertically by the motor 29 as in the case of the first embodiment.

A motor 45 is mounted above the outside bracket 42, and the shaft thereof passes through the outside bracket 42 and projects toward an oval-shaped groove 40*a* in the inside bracket 40. On the shaft of the motor 45 is fixed an eccentric ring (eccentric cam) 46, which fits in the oval-shaped groove 40*a*. Therefore, when the motor 45 is rotated, the outside bracket 42 is moved in the direction indicated by an arrow 47 in FIG. 5 (longitudinally with respect to the sheet advance direction) with respect to the inside bracket 40, and therefore with respect to the beam 3 according to the rotational angle of the eccentric ring 46.

That is to say, the two front stops 27 are independently moved longitudinally with respect to the sheet advance direction, whereby the direction of the front edge of the corrugated fiberboard sheet 7 can be changed easily.

Of two sets of the front stops, one set may be fixed to the beam 3 as before and one set may be adjustable longitudinally as described in the second embodiment. Alternatively, both of the two sets may be adjustable.

The sheet feeding apparatus for a corrugated fiberboard box making machine constructed as described above is suitable for fine adjustment of direction of the corrugated fiberboard sheet 7 because the front stops 27 can independently be moved in the longitudinal direction. In addition, this sheet feeding apparatus achieves the same operation and effect as in the case of the first embodiment, except that although the side guides 5 fixed to the beam 22 are tilted in the same way as the front stops 27 in the first embodiment, the side guides 5 are fixed in the second embodiment. However, since the quantity of tilt is very small (several millimeters at the position of the eccentric ring 32 in the first embodiment), whether the side guides 5 tilt or not has no effect on the performance of the sheet feeding mechanism.

What is claimed is:

1. In a box making machine of the type which has front stops disposed at two locations spaced from one another in the width direction to true up the front edges of stacked corrugated fiberboard sheets, and wherein the box making machine has a feeding apparatus for feeding a lowermost one of the sheets successively from the stack of sheets, the improvement wherein said front stops at the two locations are mounted so as to be moveable in a longitudinal direction for supporting the corrugated fiberboard sheets while tilting the front edges thereof obliquely in the longitudinal direction.

2. A box making machine according to claim 1, including a beam which extends in the width direction and is mounted so as to be tilted slantwise in the longitudinal direction with one end thereof in the width direction being a fulcrum, and wherein said front stops are disposed at said two locations on said beam so as to support the corrugated fiberboard sheets while tilting the front edges thereof obliquely in the longitudinal direction by moving together with said beam.

3. A box making machine according to claim 1, including a beam extending in the width direction, and wherein said front stops are disposed at said two locations on said beam and are mounted for movement individually in the longitudinal direction with respect to the beam so as to support the corrugated fiberboard sheets while tilting the front edges thereof obliquely in the longitudinal direction by moving individually in the longitudinal direction with respect to said beam.

* * * * *